United States Patent [19]

Datta et al.

[11] 4,067,467

[45] Jan. 10, 1978

[54] QUICK COUPLER DEVICE

[75] Inventors: Arthur S. Datta, Willow Springs; David G. Owens, Clarendon Hills; R. Dale Moore, Aurora, all of Ill.

[73] Assignee: International Harvester Company, Chicago, Ill.

[21] Appl. No.: 567,915

[22] Filed: Apr. 14, 1975

[51] Int. Cl.[2] ..... E02F 3/81

[52] U.S. Cl. ..... 214/145 A; 172/275

[58] Field of Search ..... 214/145 A, 131 A; 172/272, 273, 275

[56] References Cited

U.S. PATENT DOCUMENTS

| | | | |
|---|---|---|---|
| 2,963,183 | 12/1960 | Przybylski | 214/145 A |
| 3,237,795 | 3/1966 | Kromer | 214/145 A |
| 3,512,665 | 5/1970 | Westendorf | 214/145 A |
| 3,718,222 | 2/1973 | Foster | 214/145 A |
| 3,876,092 | 4/1975 | MacDonald | 214/145 A |

*Primary Examiner*—Drayton E. Hoffman
*Assistant Examiner*—Ross Weaver
*Attorney, Agent, or Firm*—Douglas W. Rudy; Floyd B. Harman

[57] ABSTRACT

A quick coupler device for use on tractor vehicles in which a quick attach plate is connected in place of the usual implement. Implements, equipped with complementary attachment fixtures, attach to the quick attach plate. A spring loaded latch automatically locks the implement to the quick attach plate and a projecting lug on the implement is engageable with a plate to hold the latch in an unlocked position.

5 Claims, 8 Drawing Figures

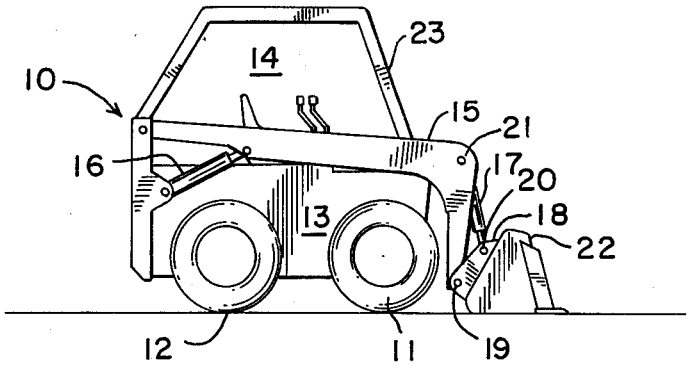
FIG. 1
FIG. 2
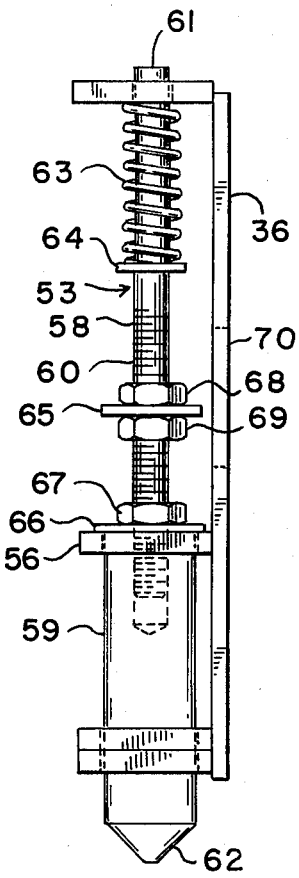

QUICK COUPLER DEVICE

BACKGROUND OF THE INVENTION

This invention relates to an improved apparatus for attaching implements to the free end of a tractor loader boom and more particularly to a latching mechanism for securing the implement on the tractor.

A widely accepted accessory on industrial tractors is the multi-implement attachment apparatus. This accessory makes it possible to equip a tractor boom with different types of alternative implements such as buckets, forks, booms, dozer blades, as well as other miscellaneous working attachments.

In the usual embodiment the implement member has a female alignment means while the boom has a male aligning means. Engagement of the male and female alignment means positions the implement in engageable relation to the tractor boom. Locking engagement is generally accomplished through the insertion of pins through the implement and boom members. The operation of changing implements is normally a difficult task as close fitting pins, rods or latches must be positioned carefully in order to insure positive attachment. Latching devices can sometimes be activated from the vehicle operator's station. However, this necessitates an additional action on the part of the operator while he is attempting to perform the other associated vehicle and implement functions. Other latching devices require the operator to enlist the aid of a second party to perform the unlatching step while the operator maneuvers the assemblages. Still other latching devices once unlatched render a loader implement connection dangerously insecure such that movement of the vehicle or the performance of implement functions may cause the implement to be disengaged from the tractor loader.

SUMMARY OF THE INVENTION

In accordance with the invention there is provided a quick attach implement apparatus for quickly coupling implements to loader vehicles. The loader boom arms and loader bucket link means are pivotally attached to a quick attach plate having a pair of male alignment posts and a spring loaded latching means. Implements to be attached to the aforesaid quick attach plate have a pair of female alignment and support sockets and a striker plate affixed to the implement. This invention makes a task of attaching implements quite easy. As the alignment posts and sockets are always in contact (even when the latching means is in an unlatched position) there is little chance of the implement falling off of the quick attach plate or loader boom. It is not necessary to have an assistant jockey the implement to be attached into position as an operator with normal skill can line up the posts of the quick attach plate with the sockets on the implement. Once the posts and sockets are aligned the operator need only roll the quick attach plate back using the loader bucket link and the latch will engage the implement automatically. There is no time lost on the part of the operator aligning fastening pins or rods.

Uncoupling of an implement is accomplished by the operator physically raising the latch plunger and retaining it in the disengaged position with the retainer plate restrained by a projecting lug. He then rolls the quick attach plate forward while lowering it causing the posts to be withdrawn from the sockets.

It is therefore, an object of this invention to provide a quick coupling of implements to loaders. An important feature of the invention is that the operator does not have to leave the loader in order to attach alternative implements although as a safety benefit he must retain the latch manually when preparing to detach an implement. Also an object of the invention is to provide a latch means which can be secured in an open (for detaching the implement) position thereby allowing the loader to deliver the implement to be removed to an appropriate storage area. Another object of the invention is to provide for positive coupling of the implements to the loader without the need for the operator to take any action to facilitate coupling. A further object of the invention is to present a quick coupler device that is rugged and simple in construction and safe in operation. These and other objects and advantages will become apparent from the following detailed description when taken in conjunction with the accompanying drawings.

BRIEF DESCRIPTION OF THE DRAWINGS

FIG. 1 is a side elevation view of a stylized loader vehicle equipped with the quick coupling device of the present invention;

FIG. 2 is a side view of the latching mechanism incorporated in the quick coupling device;

DESCRIPTION OF THE PREFERRED EMBODIMENT

Figure 3:
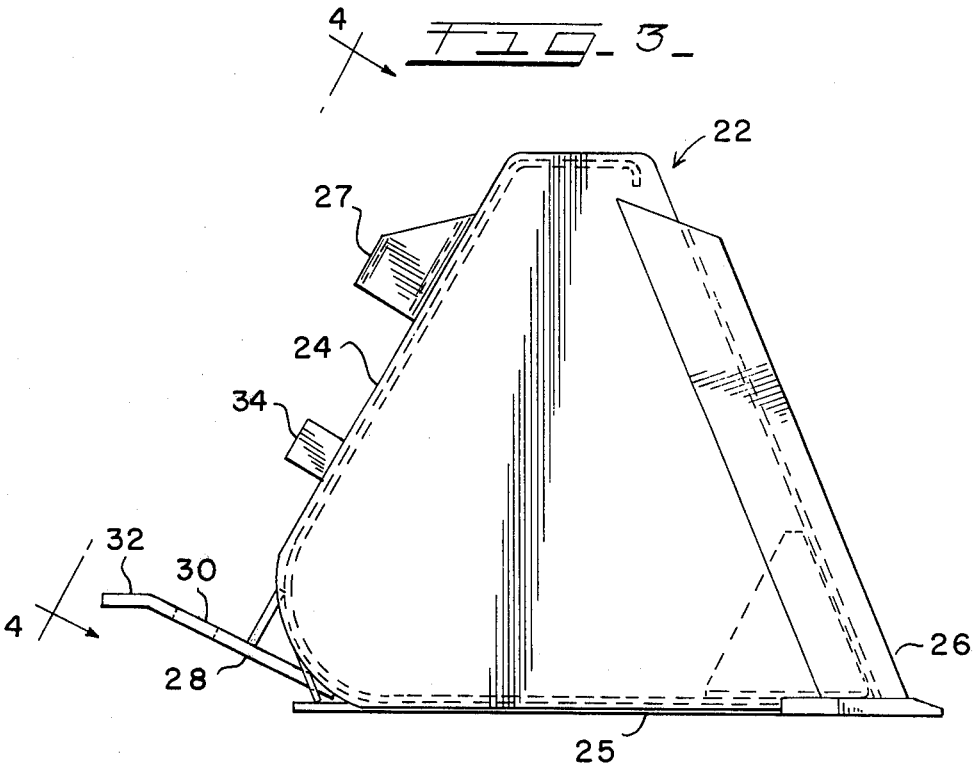
FIG. 3 is a side view of the loader bucket in readiness for coupling to a boom.

Turning now to the drawings, FIG. 1 shows a self-propelled loader vehicle generally designated by 10 having front 11 and rear 12 tractive and/or steering wheels rotatably mounted to motion transmission means (not shown) which, along with an engine means (also not shown), is carried by a body section 13 which also provides an operator's station 14. Pivotally mounted on the body section 13 is a boom means 15 which can be raised or lowered by means of a pivotally mounted boom lift cylinder 16. Carried on the forward portion of boom means 15 is a quick attach plate 18 which is pivotally attached at point 19 to the boom means 15 and at point 20 to one end of a loader bucket link 17 which has its other end 21 pivotally attached to the boom means 15. An implement, in this instance represented as loader bucket 22, is mounted on the quick attach plate 18 by means described herein. A protective frame 23 bridges the upper portion of the loader vehicle 10 including the operator's station 14.

Figure 4:
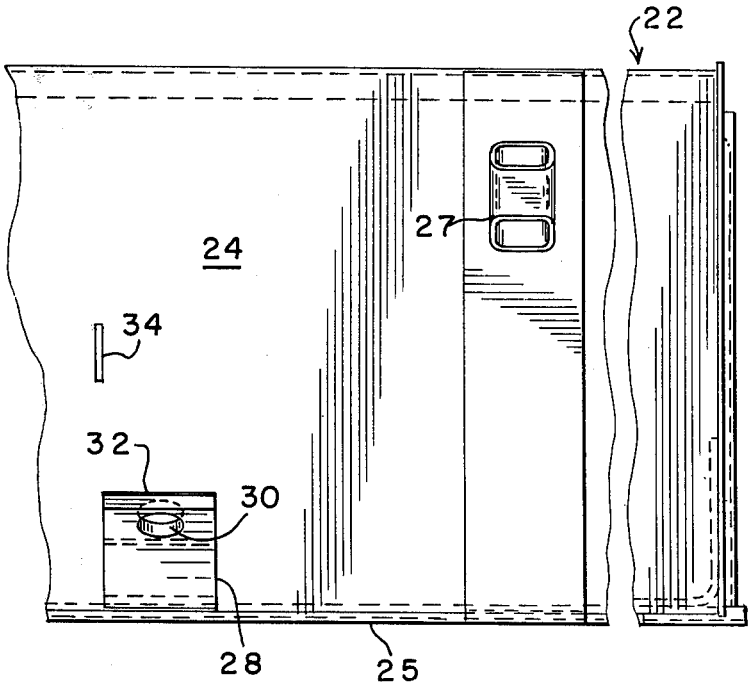
FIG. 4 is a partial view taken along lines 4—4 of FIG. 3.

Examination of FIGS. 3 and 4 shows a loader bucket 22 having a back wall 24 a bottom wall 25 housing a front leading edge 26. Secured to the back wall 24 is a socket 27 which is, in this embodiment, formed of a square tube. The socket 27 is fixedly attached such as by welding to the exterior surface of the back wall 24 of the loader bucket 22. Two sockets, one shown as 27, are mounted outboard of the center of the bucket 22. Centrally located adjacent to the bottom wall 25 is a striker plate 28. The striker plate 28 is provided with an aperture 30 as well as a striker surface 32. The striker plate 28 is fixedly attached to the loader bucket 22 by any suitable means such as welding. Located generally above the striker plate 28 is a projecting lug 34 which in the preferred embodiment is a rectangular tab fixedly attached to the exterior surface of the back wall 24 of the loader bucket 22.

Figure 5:
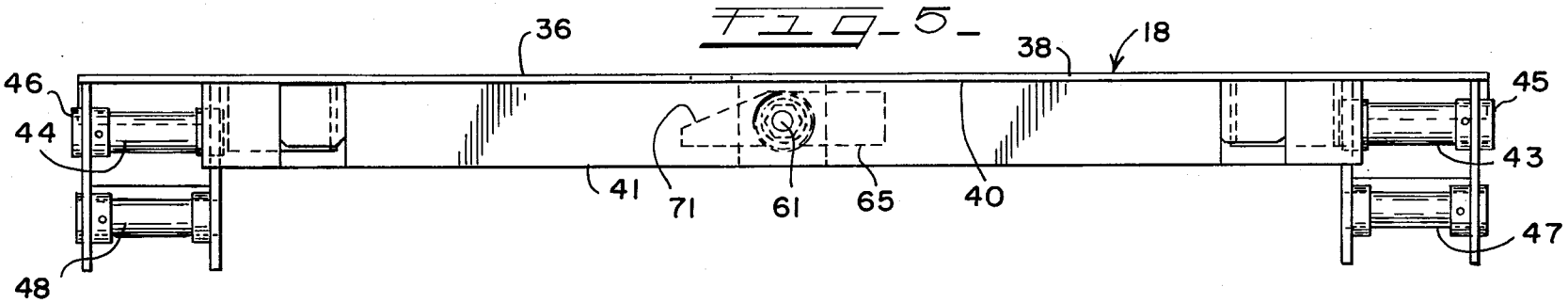
FIG. 5 is a plan view of the quick attach plate.
Figure 6:
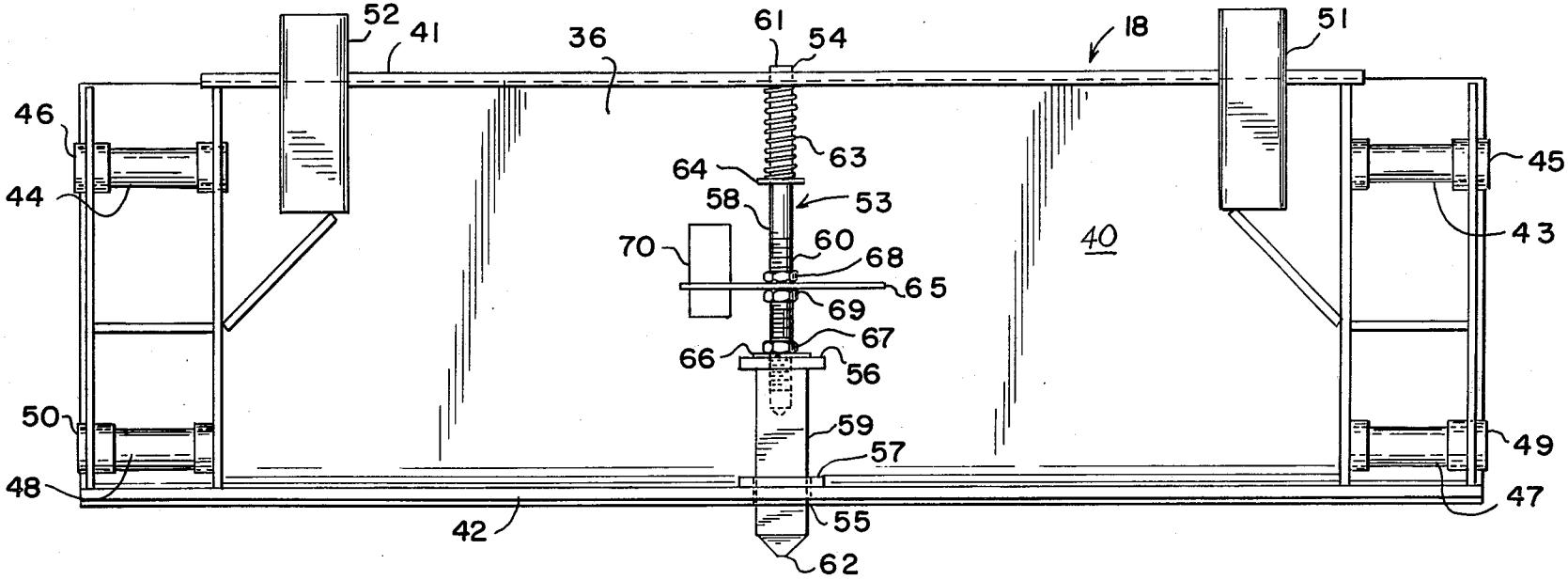
FIG. 6 is an elevation view of the quick attach plate.

Referring now to FIGS. 5 and 6 wherein detail of the quick attach plate 18 is shown as a generaly rectangular plate means 36 having a flat front surface 38 and a rear surface 40. An upper shelf 41 and a lower shelf 42 project rearward at right angles from plate means 36. The view in FIG. 6 is that of the rear surface 40 wherein means to attach the quick attach plate 18 to the boom means 15 and the loader bucket link 17 (FIGS. 1 and 7) is provided. Specifically first right and left pin means, 43 and 44, pass through the right and left upper pairs of mounting apertures, 45 and 46, and corresponding apertures (not shown) in the lower portion of the loader bucket link 17 at pivot point 20 of FIG. 1. Second right and left pin means, 47 and 48, pass through right and left lower pairs of mounting apertures, 49 and 50 respectively, and corresponding apertures (not shown) in the boom means 15 to provide a pivot point at 19 of FIG. 1. All pin means being suitably secured in position.

Spaced apart posts 51 and 52 (right and left respectively) projecting above the top of the plate means 36 function as male member means. There are two such members, one to engage each of the aforementioned sockets, one shown as 27 in FIG. 3 located on the exterior surface of the backwall 24 of the loader bucket 22.

Generally centrally located on plate means 36 is latching means 53 pivotally secured to the plate means 36 by the provision of first and second, 54 and 55, apertures and apertured retaining tab 56 and apertured alignment tab 57. Latching means 53 (shown also in FIG. 2) consists of, a plunger 58 with a head piece 59 and a threaded shaft 60 having first and second ends 61 and 62, a biasing means shown as a spring 63 supported by stop 64 journalled by shaft 60 normally resisting upward movement of the assembly, a retainer plate 65 secured to the shaft 60 such that the major plane of the retainer plate 65 and the major plane of the plunger 58 are generally perpendicular. Also part of the latching means 53 is a plunger retaining washer 66, held in place by a jam nut 67, having an outside diameter greater than the diameter of the aperture in the apertured retaining tab 56.

The plunger 58 is fully adjustable by screwing the head piece 59 up or down on the shaft 60 and then locking it in place with jam nut 67 (acting on plunger retaining washer 66). Retainer plate 65 being adjustable upwardly or downwardly on shaft 60 through adjustment of first lock nut 68 and second lock nut 69 on the threaded shaft 60.

An aperture means 70 is cut in the plate means 36, such that when plate means 36 is mated with the loader bucket 22, (FIGS. 7 and 8) the projecting lug means 34 can pass through the aperture means 70.

Referring to FIG. 5 it will be apparent that retainer plate 65 is generally rectangular having one of corner 71 thereof tapered. As will be appreciated the entire latching means 53 is movable in a vertical plane, that is, up and down against spring 63 and can also be partially rotated around its major axis.

Figure 7:
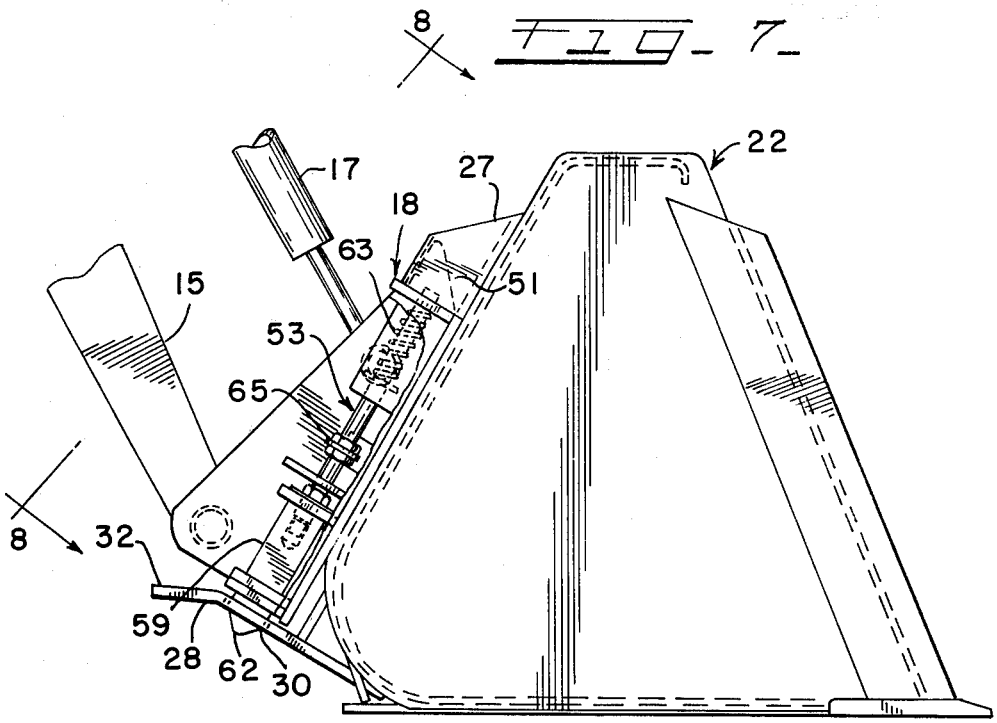
FIG. 7 is a side view of the loader bucket mounted to the boom in a coupled position.
Figure 8:
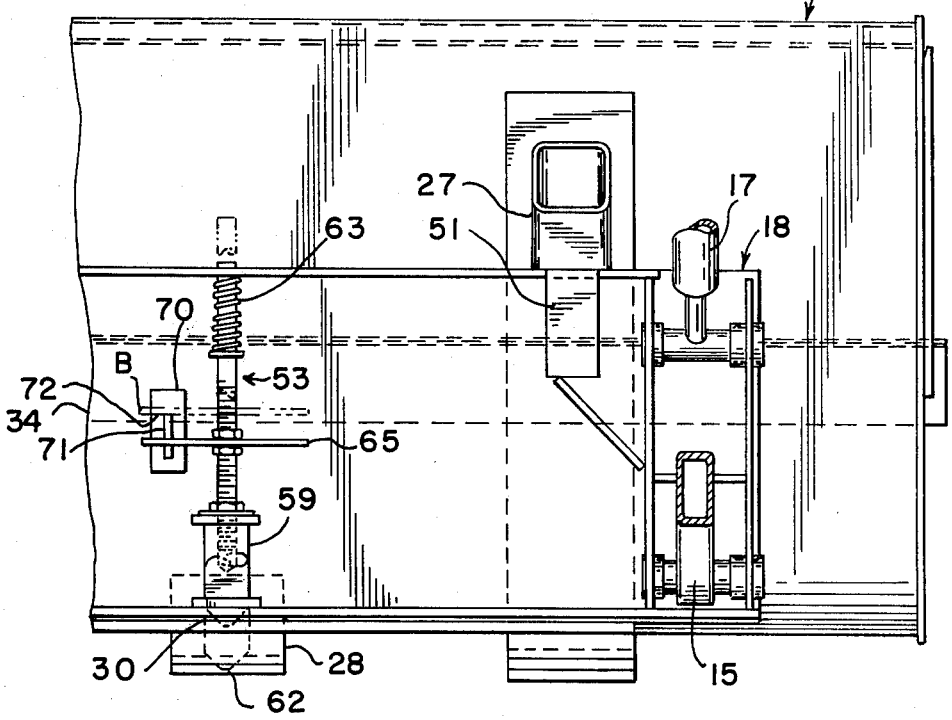
FIG. 8 is a partial view taken along line 8—8 of FIG. 7.

Referring now to FIGS. 7 and 8, wherein the quick attach plate 18 and the loader bucket 22 have been coupled, the operation of the coupling will be explained. In practice the quick attach plate 18 is secured to the boom means 15 and loader bucket link 17 as previously explained. This resulting assemblage thereafter is maneuvered such that posts 51 and 52 can be inserted into the sockets, one shown as 27. Once this step is accomplished the loader bucket link 17 is actuated to roll back the quick attach plate 18 such that latching means 53 and more particularly second end 62 is caused to ride up on striker surface 32. This action causes the entire latching means 53 to be moved upwardly with the resulting compression of spring 63. Head piece 59 slides along the striker surface 32 of the striker plate 28 until it reaches aperture 30 at which time spring 63 causes the second end 62 of plunger 58 to be passed thereinto. Once this orientation has been achieved the loader bucket assemblage is firmly secured to the boom assemblage. Thereafter they can be worked as if they were permanently secured.

When it is desired to uncouple the loader bucket assembly from the boom assembly it is only necessary to level the quick attach plate 18, grasp retainer plate 65, pull it upwardly against spring 63 and pivot the locking assembly such that corner 71 rests on the top edge means 72 of projecting lug 34. This is shown in phantom position B in FIG. 8. As is apparent posts 51 and 52 are still carried within sockets, right shown as 27, and thus for all practical purposes the assembly is still linked together. This allows the loader bucket assembly 22 to be moved, or otherwise maneuvered and detached without further unlocking steps being required. For instance, the vehical could deliver and deposit the implement in an elevated truck bed without the operator having to get up in the truck to unlatch the implement from the boom assemblage. Once the unlocking function has been performed it is not necessary thereafter to repeat it, that is it is not necessary to perform the unlocking step immediately prior to uncoupling the assemblage. Further, when the loader bucket 22 is uncoupled from the quick attach plate 18 projecting lug 34 is pulled out from aperture means 70 and by virtue of spring 63, latching means 53 is automatically returned to a latchable position. This step being achieved without any action on the part of the operator.

Thus it is apparent that there has been provided in accordance with the invention, a quick coupler device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A quick coupling device for use in detachably mounting an implement on loader vehicles equipped with boom arms and implement link means comprising:

an implement having a plurality of sockets mounted to the upper rear surface of the implement and a projecting lug secured to the implement in the center of the rear surface of the implement and an apertured striker plate mounted to the lower rear surface of the implement;

a quick attach plate having means for pivotal attachment to the boom arms and the implement link means and having a plurality of posts secured to the upper portion of the quick attach plate for telescopically engaging the sockets of the implement and the quick attach plate further equipped with a centrally located aperture aligned to accept the passage of the projecting lug of the implement when the implement is engaged with the quick attach plate;

a latching means carried on the rear surface of the quick attach plate having a head portion engageable with the apertured striker plate of the implement further having a retainer plate integral with the latching means capable of engagement with the projecting lug of the implement.

2. A coupling for use in detachably mounting an implement on the free end of a movable boom, said coupling comprising, a generally rectangular frame having upper and lower sides, opposite ends and being pivotally mounted on the free end of the boom for bodily movement therewith, first and second telescopically interfitting connections formed between the rearward side of the implement and the upper side of said frame and being spaced from each other a predetermined distance, each of said connections including a male part on one of said frame and the implement and a female part on the other of said frame and the implement, said parts being telescoped with each other to pick up the implement on the end of the boom as the latter is swung through a predetermined arc closely approaching the rearward side of said implement, a third and final interfitting connection between said frame and the implement including a bolt slidably mounted below and between said first and second connections and on one of said frame and the implement for generally lateral movement with respect thereto between a retracted position and a projected position, a spring acting between said bolt and said one of said frame and the implement and urging said bolt into its projected position and tongue mounted on the other one of said frame and the implement and interfitting with said bolt to secure the implement detachably on the free end of the boom, and means on said frame and said implement being adapted to support said bolt in its retracted position away from interfitting engagement with said tongue for uncoupling the implement from the boom and coacting with said spring whereby said bolt slides into its projected position as an incident to moving the boom away from the implement.

3. The invention as defined in claim 1 wherein said latching means further comprises:

a threaded vertical shaft;

a stop fixedly attached to said vertical shaft for limiting travel of said biasing means on said vertical shaft;

a head piece removably attached at the lower end of said vertical shaft for insertion into said striker aperture;

a retainer plate adjustably mounted on said shaft and capable of resting on top of said projecting lug when said latching means is retracted from said aperture; and a biasing means carried by said latching means for urging said latching means into said striker plate aperture.

4. In a vehicle having a forwardly extending vertically adjustable supporting structure, including a pair of boom arms and loader link means, and a detachable implement having a projecting lug, the implement comprising:

a quick attach plate having aligned apertures for permitting pivotal attachment of said plate to said boom arms and said loader link means;

pin means for securing said boom arms and said loader link means to said quick attach plate, whereby extension and retraction of said loader link means results in pivotal movement of said quick attach plate relative to said boom arms;

a pair of female sockets affixed to said implement;

a pair of male posts secured to and projecting above said quick-attach plate, said posts being complementary to and engageable with said sockets;

a striker plate having an aperture secured to said bucket;

a plunger engageable with said aperture and mounted for reciprocating motion on said quick attach plate;

a biasing means carried by a threaded shaft of said latching means for urging said plunger into said aperture; and a retainer plate for holding said plunger out of said aperture of said striker plate when said retainer plate is maintained on top of said projecting lug.

5. A quick attach plate for effecting the releasable attachment of an implement comprising:

a plate means;

a plurality of post means mounted outboard from the center of said plate means on the upper portion thereof and protruding above the upper portion of said plate means;

a latching means reciprocally mounted on said plate means having a threaded shaft, a head piece adjustably secured to the lower end of said shaft, a biasing means including a spring journalled on said threaded shaft and retained between said plate means and a stop, alignment means for positioning said latching means, and a retainer plate adjustably mounted on said threaded shaft;

said plate means having an aperture formed therein for permitting access to said latching means.

* * * * *